United States Patent [19]

Marsais et al.

[11] Patent Number: 4,903,762

[45] Date of Patent: Feb. 27, 1990

[54] HEAT EXCHANGER INCLUDING A BANK OF FINNED TUBES AND A SHELL SURROUNDING SAID BANK

[75] Inventors: Christian Marsais, Rambouillet; Hervé Dupuis, Montreuil, both of France

[73] Assignee: VALEO, Paris, France

[21] Appl. No.: 274,905

[22] Filed: Nov. 22, 1988

[30] Foreign Application Priority Data

Nov. 27, 1987 [FR] France ..... 87 16451

[51] Int. Cl.[4] ..... F28F 1/10

[52] U.S. Cl. ..... 165/149; 165/78

[58] Field of Search ..... 165/78, 149

[56] References Cited

U.S. PATENT DOCUMENTS 4,303,052 12/1981 Manfredo ..... 165/149 X

*Primary Examiner*—Robert G. Nilson

*Attorney, Agent, or Firm*—Dennison, Meserole, Pollack & Scheiner

[57] ABSTRACT

The invention relates to a heat exchanger, particularly for motor vehicles, including at least one water tank disposed at one end of a bank (6) of tubes (8) with fines (7) through which a first fluid flows and a shell (2), such as a casing (9), defined by walls (12, 13, 14, 15) surrounding said bank and through which a second fluid flows. In this exchanger, two sides of the bank are adjacent to walls (12, 13, 14, 15) of the casing (9) braced against one another by assembly means positioning the bank (6) and supported by it. This exchanger is characterized in that the assembly means comprise mutual sliding engagement means (21, 23, 25, 26, 34) supported respectively in part by the bank (6) and by at least one of the walls (12, 13, 14, 15) of the casing (9). The invention relates in particular to motor vehicles.

2 Claims, 1 Drawing Sheet

HEAT EXCHANGER INCLUDING A BANK OF FINNED TUBES AND A SHELL SURROUNDING SAID BANK

FIELD OF THE INVENTION

The present invention relates to a heat exchanger, in particular for motor vehicles. This heat exchanger includes at least one water tank, disposed at one end of a set of finned tubes through which a first fluid flows, and a shell which surrounds the bank of tubes and through which a second fluid flows. Such a heat exchanger is part of an installation used for cooling a fluid, and more particularly for cooling the air that emerges from a turbocharger and is intended for supercharging the thermal engine.

BACKGROUND OF THE INVENTION

The fluid that flows through the shell and passes through the set of finned tubes is this supercharging air. The bank also has another fluid flowing through it, which under the circumstances is the fluid used by the circuit that cools the engine, generally a mixture of water and antifreeze.

The shell may be a casing, in general providing a housing open at at least one end, into which the bank is inserted by sliding, in the manner of a drawer. The casing is then closed by a lid in such a way as to make an enclosure, which to cool the supercharging air includes an inlet connection piece and an outlet connection piece for such air; the air arriving via the inlet connection piece passes through the bank in the heat exchanger and can be cooled there.

However, it has been found that the prevailing pressure of the supercharging air in the enclosure is such that the walls of the shell tend to deform, bulging outward, and even to break apart in extreme cases. This problem is further exacerbated by the fact that most often, a plastic shell is used, to reduce the weight and hence the cost.

An attempt to solve this problem has already been made, in particular in U.S. Pat. No. 4,436,145, published on Mar. 13, 1984. In this embodiment, a bank of finned tubes has two water tanks and includes hollow cylindrical sleeves slightly longer than the thickness of the bank and passing all the way through the bank, being disposed at intervals along the bank and parallel to one lateral face of the heat exchanger. The bank is then slid in the manner of a drawer into a casing on a single open side, so as to be assembled with it, in the course of which the ends of the sleeves come into contact with the inside faces of the walls of the casing and act as braces. Corresponding to the cylindrical sleeves, the walls have bores through which screws can be introduced. These screws, via the bores disposed over the first wall, engage the inside of the hollow cylindrical sleeves, passing all the way through the bank of tubes, and discharging via the bores disposed over the second wall, which is parallel to and opposite the first wall. The screw heads rest on the outside face of the first wall, and nuts are screwed onto the shafts of the screws, which extend past the second wall, so as to assure a connection between the two walls of the casing and the bank.

Thus, on the one hand the bank is immobilized in terms of translation in the casing by the sleeves and is blocked in the casing by the screws, and on the other hand, possible deformation of the walls is prevented by these same screws that form tie rods.

Such an embodiment nevertheless has some disadvantages. The hollow cylindrical sleeves must actually be of a major diameter, to be able to withstand the locking effort exerted by the screw and nut. Furthermore, the emplacement of these sleeves on the one hand necessitates occupying a space such that one tube of the bank must be omitted; on the other hand, bores must be provided for receiving the sleeves through this bank, and the bores require that the fins be cut along their length.

Accordingly, this arrangement lowers the capacity of the heat exchanger and also requires additional manipulation to place the screws through the bank and lock them, and these operations entail additional assembly expense.

OBJECT AND SUMMARY OF THE INVENTION

The object of the present invention is to overcome these disadvantages by simplifying and facilitating the assembly of the bank with the shell or casing containing it, while preserving the capacity of the heat exchanger.

To this end, it proposes a heat exchanger, in particular for motor vehicles, including at least one water tank disposed at one end of a bank of tubes with fins through which a first fluid flows and a shell, such as a casing, defined by walls surrounding said bank and through which a second fluid flows. In the heat exchanger, two sides of the bank are adjacent to walls of the casing braced against one another by assembly means positioning the bank and supported by it; this exchanger is characterized in that the assembly means comprise mutual sliding engagement means each supported in part by the bank and by at least one of the walls of the casing.

More particularly, the mutual engagement means comprise at least one mortise-and-tenon type of assembly.

According to the invention, the bank need merely be introduced into its housing, and it will then be positioned correctly, while at the same time assuring the connection of the bank with the walls of the casing, in such a way as to prevent deformation of the walls.

The ensuing detailed description will describe particular features of the invention, in terms of exemplary but non-limiting embodiments, referring to the accompanying drawings.

DESCRIPTION OF THE PREFERRED EMBODIMENTS

Figures 1, 2, 3, 4, 5:
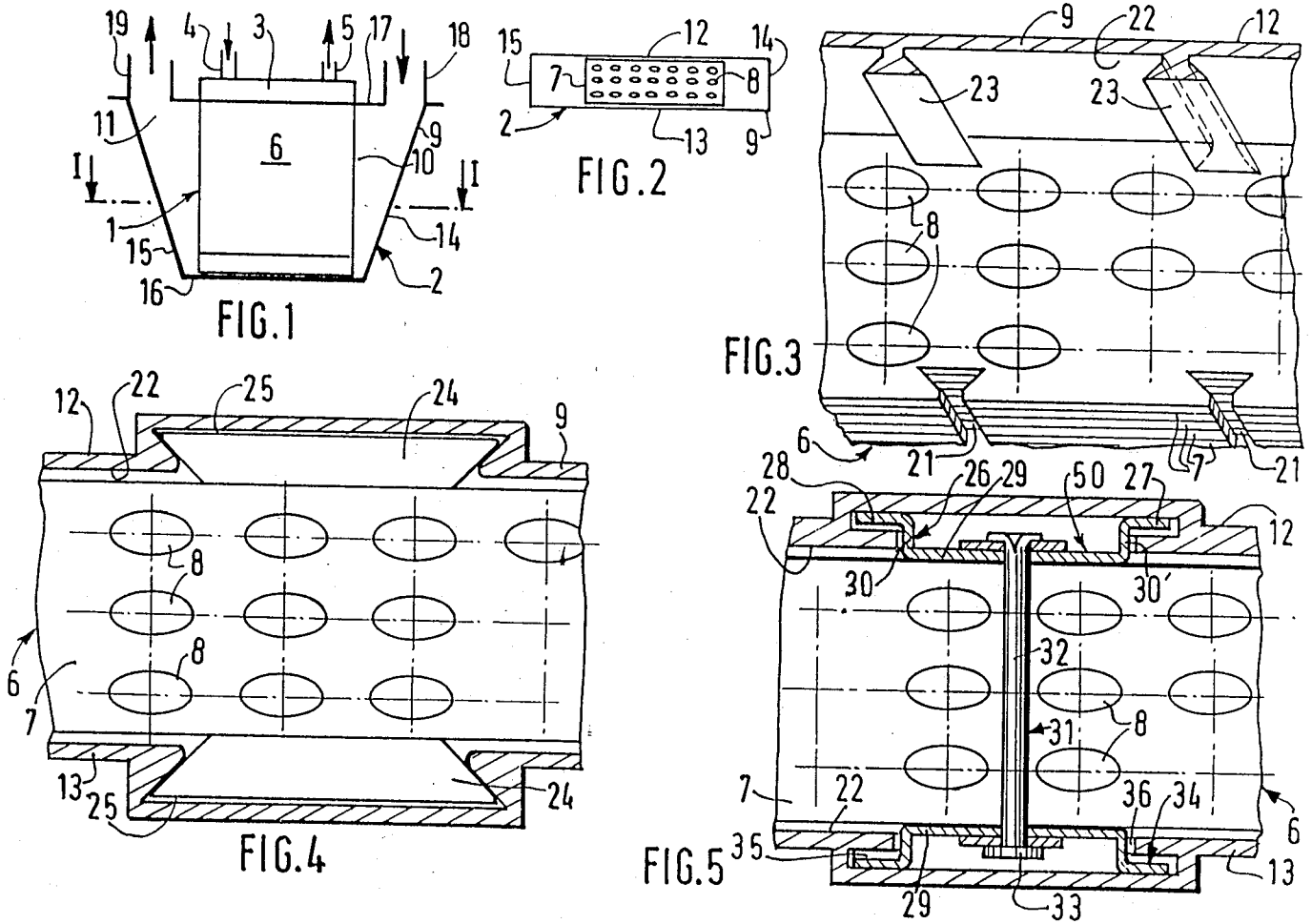
FIG. 1 is a schematic view showing the heat exchanger.
FIG. 2 is a sectional view taken along the line I—I of FIG. 1.
FIG. 3 is a perspective view showing an assembly of the bank of finned tubes and the casing according to the invention.
FIG. 4 is a fragmentary sectional view showing a variant of the invention.
FIG. 5 is a fragmentary sectional view showing another variant of the invention.

Referring first to FIGS. 1 and 2, a heat exchanger is shown including a bank 6 of tubes 8 with fins 7 and a shell 2 containing it.

The bank 6 is provided with at least one water tank 3 including inlet connection pieces 4 and outlet connection pieces 5 for the heat transfer or coolant fluid. In the manner of a drawer, the bank is slid into the shell 2, in this case a casing 9, furnishing a housing 10 that is open at one end 11.

This casing is of generally parallelepiped form defined by two parallel, opposed long walls 12, 13, two opposed short walls 14, 15 inclined toward one another, and a bottom 16. The open end 11 is closed after the bank 6 is introduced into the housing 10 by a lid 17 including inlet connection pieces 18 and outlet connection pieces 19 for the coolant fluid.

The assembly thus formed comprises an apparatus for cooling the air emerging from a supercharger and intended for supercharging the thermal engine of a motor vehicle. This air, arriving via the inlet connection piece 18, enters the casing 9, passes through the heat exchanger bank 6, and leaves via the connection piece 19, having been cooled by its passage through the bank.

It is inside the casing 9 that a rather high air pressure prevails, which has a tendency to deform the walls 12, 13 outward.

The present invention proposes to overcome this disadvantage, as can be better seen from FIG. 3. In FIG. 3, the bank 6 of finned tubes is connected to the casing 9 by mutual engagement means.

More precisely, at least one front side of the bank 6, and in this case both of them, include at least one groove 21 or mortise, here in the form of a dovetail, made along the edge of the fins 7. Similarly, an inside face 22 of at least one wall, in this case the two walls 12, 13, has at least one projecting tenon 23, complementary in shape and disposition to those of the mortise 21, hence in the form of a dovetail disposed facing the mortise over the entire length of the wall in question.

The assembly of the bank 6 with the casing 9 is effected in the following manner:

The bank 6 is presented facing the open end 11 of the casing 9 such that the mortises 21 of the bank 6 are disposed corresponding to the tenons 23. The bank is then introduced into the housing 10, by sliding the mortises 21 over the tenons 23 by mutual engagement, until the bank is entirely inside the housing. After that, the lid 17 is mounted on the open end 11 to close it.

Thus the bank is blocked in a first direction by the bottom 16 and the lid 17, and in the other two directions by the mortise-and-tenon assembly of complementary shapes. This assembly also makes it possible to prevent deformation of the walls 12, 13 of the casing 9, when the supercharging air is admitted, by creating a rigid connection between the front sides of the bank 6 and the inside face of the walls 12, 13, while allowing optional later removal of the bank 6 from the housing 10.

Reference is now made to FIG. 4, which shows a variant embodiment of the assembly.

In this figure, the bank 6 includes at least one tenon 24, here in the form of a dovetail, disposed on at least one front side of the bank, in this case on both sides.

The tenon 24 may either by part of a projection originating in each case from the front edge of the pins 7 of the bank 6, so as to form a longitudinal tenon equal in length to the length of the bank and being parallel to one side face of the bank 6, or may, at the time the heat exchanger bank is manufactured, be part of a mounting of at least one fin of greater thickness than the fins 7 and including a projection forming a tenon 24. This fin may be disposed at regular intervals in the stack of fins 7; for example, there may be one such large fin every 20 or 30 fins 7. Thus in practice, it is sufficient for at least one fin of greater thickness to be disposed in the middle of the bank.

The wall or walls 12, 13 of the casing 9, beginning at their inside faces 22 and extending to past their outside faces, include at least one groove 25 or mortise, complementary in shape and disposition to those of the tenon 24; that is, it is in the form of a dovetail, located corresponding to the tenon 24, over the entire length of the wall in question.

The bank is assembled together with the casing 9 in the same manner as described for FIG. 3.

FIG. 5 shows another variant embodiment of the assembly according to the invention.

In this embodiment, at least one tenon 26 is mounted on at least one front side of the bank 6. It is formed by a plate 50 generally in the shape of a T, the horizontal bar of the T comprising two branches 27, 28 which are parallel to the front side of the bank, the vertical bar being hollowed out beginning at the intersection with the horizontal bar, in such a way as to leave an open end, the base of the vertical bar forming a wall 29 parallel to the front face and pressed against and connecting the branches 27, 28 via respective perpendicular walls 30, 30' spaced apart from the wall 29.

This plate 50, mounted on a front face of the bank along its length and parallel to one side face, is fixed to the bank by any suitable means, for example by soldering.

In the case where, as can be better seen in the drawing, a plate 50 is provided that forms a tenon 26 on each front face of the bank 6, the intention is for each tenon to be connected through the heat exchanger bank by any suitable means, such as by a flat bar 31 comprising a rectangular plate 32 capable of passing through the available space between two fins and at one end including an enlarged portion forming a support head 33.

Thus when the plates 50 are mounted on the bank, it is sufficient to have a bar 31 pass through the bank 6 via an orifice provided in the partition 29 of a first plate 50. After the heat 33 of this bar is resting on the partition 29 of the first plate 50, and after the other end has been made to extend beyond the partition 29 of the other plate 50 disposed facing it, it is sufficient to flare out this other end, in order to procure a rigid connection between the two plates 50.

The wall or walls 23 have at least one recess 34 or mortise complementary in shape and disposition to those of the tenon 26, that is, being in the form of a T, rising from their inside faces 22 projecting toward the outside of the walls, the horizontal bar of the T comprising a lontitudinal groove 25 and the vertical bar comprising a longitudinal groove 36.

The assembly of the bank 6 in the casing is identical to what has been described above.

The present invention is not limited to the exemplary embodiments described above; it encompasses all variants thereof without departing from the scope of the invention.

In particular, the casing 9 may be in two separate parts, each being open at one end. Then, after the bank of finned tubes has been introduced into the first part, by sliding the mortises or tenons on the bank along the tenons or mortises of the first part, all that needs to be done is to slide the tenons or mortises of the second part of the casing along the mortises or tenons on the bank.

Moreover, it is possible for the front face of the bank and the inside face of the wall each to have a tenon or mortise in identical fashion, and an intermediate connecting piece may be provided that has shapes for mutual engagement with shapes formed on this front face and this inside face, and it may be slid either in the tenons or the mortises, so as to assure connection between the wall and the bank.

What is claimed is:

1. A heat exchanger, in particular for motor vehicles, including at least one water tank disposed at one end of a bank (6) of tubes (8) with fins (7) through which a first fluid flows, and a shell (2), such as a casing (9), defined by walls (12, 13, 14, 15), surrounding said bank and through which a second fluid flows, in which heat exchanger two sides of the bank are adjacent to the walls (12, 13, 14, 15) of the casing (9), which are braced against one another by assembly means that position the bank (6) and are supported thereby, characterized in that the assembly means comprise sliding mortise and tenon mutual engagement means (21, 23, 25, 26, 34) carried respectively by the bank (6) and at least one of the walls (12, 13, 14, 15) of the casing (9), forming means of bracing and retaining said walls, and wherein said tenon (23) is formed on an inside face (22) of at least one wall (12, 13) of the casing (9), the mortise (21) being formed on at least one front face of the bank (7) of tubes (8) having fins (7).

2. A heat exchanger as defined by claim 1, characterized in that the tenon (23, 24, 26) is the form of a dovetail.

* * * * *